US008270653B2

(12) United States Patent
Yamagushi et al.

(10) Patent No.: US 8,270,653 B2
(45) Date of Patent: Sep. 18, 2012

(54) MICROPHONE-UNIT SUPPORTING STRUCTURE AND ELECTRONIC DEVICE

(75) Inventors: Atsuko Yamagushi, Kanagawa-ken (JP); Keita Shimizu, Kanagawa-ken (JP)

(73) Assignee: Kabushiki Kaisha Kenwood, Tokyo (JP)

( * ) Notice: Subject to any disclaimer, the term of this patent is extended or adjusted under 35 U.S.C. 154(b) by 97 days.

(21) Appl. No.: 12/929,127

(22) Filed: Jan. 3, 2011

(65) Prior Publication Data

US 2011/0188695 A1 Aug. 4, 2011

(30) Foreign Application Priority Data

Jan. 29, 2010 (JP) ..... 2010-019296

(51) Int. Cl.
*H04R 25/00* (2006.01)

(52) U.S. Cl. ..... 381/361; 381/355

(58) Field of Classification Search ..... 381/91, 381/92, 122, 355, 359, 360, 361, 364, 365, 381/366, 367, 368; 379/428.01, 433.03; 455/575.1, 575.2, 90.2, 90.3
See application file for complete search history.

(56) References Cited

U.S. PATENT DOCUMENTS

| | | | | |
|---|---|---|---|---|
| 5,613,011 | A * | 3/1997 | Chase et al. | 381/361 |
| 6,068,235 | A * | 5/2000 | Gaffney et al. | 248/694 |
| 2011/0188676 | A1 * | 8/2011 | Momose et al. | 381/122 |

FOREIGN PATENT DOCUMENTS

| | | |
|---|---|---|
| JP | 11-68259 | 3/1999 |

* cited by examiner

*Primary Examiner* — Huyen D Le
(74) *Attorney, Agent, or Firm* — Louis Woo

(57) ABSTRACT

A microphone-unit supporting structure comprises a microphone unit and a holder. The microphone unit includes a substantially-cylindrical microphone element, a printed circuit board fixed to a back of the microphone element, and at least two projections extending radially outward from the printed circuit board and being circumferentially spaced at such an angular interval that when one of the projections is assumed to be on a reference line for line symmetry, the other projection or projections are off the reference line. The holder includes a microphone-unit supporting portion for supporting the microphone unit. The holder has a first groove for receiving first one of the projections, and a second groove for receiving second one of the projections. The first groove is open in a backward direction. The second groove is open in a frontward direction.

5 Claims, 3 Drawing Sheets

MICROPHONE-UNIT SUPPORTING STRUCTURE AND ELECTRONIC DEVICE

BACKGROUND OF THE INVENTION

1. Field of the Invention

This invention relates to an improvement on a microphone-unit supporting structure in a microphone-element-equipped electronic device such as a portable radio communication device. This invention particularly relates to a microphone-unit supporting structure which can secure a microphone unit in an electronic device while providing a good waterproof performance and an excellent reproducibility during assembly.

2. Description of the Related Art

For a microphone-element-equipped electronic device such as a radio communication device, a telephone set, a personal computer, a speech recognition device, or an interphone device, it is desirable to surely locate and secure a microphone element in the electronic device while proving a good waterproof performance with respect to the microphone element.

In the case where the microphone element is directly fixed to a main printed circuit board of the electronic device, output terminals provided on the back of the microphone element are soldered to a wiring pattern on the main printed circuit board so that the microphone element is electrically connected to the wiring pattern while being mechanically fixed to the main printed circuit board.

In this case, the position of the microphone element relative to the main printed circuit board is uniquely decided, and hence there may occur a low degree of freedom of a structural layout in the electronic device. When the microphone element is located at a deep position within a casing of the electronic device, the sound propagation path between the microphone element and an outer plane of the casing is relatively long so that the quality of sound picked up by the microphone element tends to be lowered.

Japanese patent application publication number 11-68259 discloses that a portion of a main printed circuit board forms a sub printed circuit board provided with a microphone. Leads connected between the main board and the sub board establish electrical connection of the microphone to the main board. The sub board can easily be separated from the main board. After separated from the main board, the microphone on the sub board is fitted into a recess in a casing accommodating the main board.

In Japanese application 11-68259, it seems that the microphone can be fitted into the recess while taking any one of different postures angularly spaced at 90-degree intervals. Accordingly, there is a chance that during assembly, a worker may make a mistake about the angular orientation of the microphone relative to the recess.

To allow a microphone element to pick up sound from the outside of a casing, the microphone element is positioned within the casing at a place which communicates with the outside via a hole or holes. In the case where a microphone element separates the interior of a casing into a space accommodating a main printed circuit board and a space communicating with the outside of the casing, it is conceivable to provide an elastic packing member around the microphone element to make a waterproof structure. Variations in microphone element size, microphone element position relative to a related printed circuit board, microphone element position relative to a related casing, and microphone element position relative to the packing member are absorbed only by the elasticity of the packing member. When greatly deformed from its original shape to absorb such variations, the packing member receives an excessive stress. Such an excessive stress accelerates the deterioration of the waterproofness provided by the packing member.

SUMMARY OF THE INVENTION

It is a first object of this invention to provide a microphone-unit supporting structure which can stably secure a microphone unit in both a sound path direction and a microphone-element circumferential direction with a good reproducibility, which can absorb variations such as those mentioned above, and which can ensure stable waterproofness.

It is a second object of this invention to provide an electronic device which can stably secure a microphone unit in both a sound path direction and a microphone-element circumferential direction with a good reproducibility, which can absorb variations such as those mentioned above, and which can ensure stable waterproofness.

A first aspect of this invention provides a microphone-unit supporting structure comprising a microphone unit and a holder. The microphone unit includes a substantially-cylindrical microphone element having a front and a back, a printed circuit board fixed to the back of the microphone element, and at least two projections extending radially outward from the printed circuit board and being circumferentially spaced at such an angular interval that when one of the projections is assumed to be on a reference line for line symmetry, the other projection or projections are off the reference line. The holder includes a microphone-unit supporting portion having a front, a back, and an inner wall surface and supporting the microphone unit in a manner such that at least a back end part of the microphone unit is loosely fitted in the microphone-unit supporting portion and at least a part of a side of the microphone unit faces the inner wall surface, a seat projecting from the inner wall surface and supporting a part of the printed circuit board, a first groove extending outward from the inner wall surface and receiving first one of the projections to loosely support the first one of the projections, and a second groove extending outward from the inner wall surface and receiving second one of the projections to loosely support the second one of the projections, the first groove being open in a backward direction, the second groove being open in a frontward direction.

A second aspect of this invention is based on the first aspect thereof, and provides a microphone-unit supporting structure further comprising a loudspeaker, a cushion supporting a back of the loudspeaker, and a loudspeaker supporting portion provided in the holder and having a recess, the loudspeaker supporting portion supporting the loudspeaker and the cushion in a manner such that the loudspeaker and the cushion are fitted in the recess, the loudspeaker supporting portion being adjacent to the microphone-unit supporting portion, the second groove communicating with the recess, the cushion being in watertight contact with a part of the second one of the projections which is in the second groove.

A third aspect of this invention is based on the first aspect thereof, and provides a microphone-unit supporting structure further comprising a packing fitting over a front of the holder and having an opening for accommodating the microphone element and a rib projecting into the opening, the rib being in watertight contact with a side surface of the microphone element throughout its circumference.

A fourth aspect of this invention is based on the first aspect thereof, and provides a microphone-unit supporting structure wherein the projections are formed when the printed circuit board is separated from an original printed circuit board by trimming.

A fifth aspect of this invention provides an electronic device comprising a microphone unit, a holder, a loudspeaker, a cushion supporting a back of the loudspeaker, and a packing fitting over a front of the holder. The microphone unit includes a substantially-cylindrical microphone element having a front and a back, a printed circuit board fixed to the back of the microphone element, and at least two projections extending radially outward from the printed circuit board and being circumferentially spaced at such an angular interval that when one of the projections is assumed to be on a reference line for line symmetry, the other projection or projections are off the reference line. The holder includes a microphone-unit supporting portion having a front, a back, and an inner wall surface and supporting the microphone unit in a manner such that at least a back end part of the microphone unit is loosely fitted in the microphone-unit supporting portion and at least a part of a side of the microphone unit faces the inner wall surface, a seat projecting from the inner wall surface and supporting a part of the printed circuit board, a first groove extending outward from the inner wall surface and receiving first one of the projections to loosely support the first one of the projections, a loudspeaker supporting portion being adjacent to the microphone-unit supporting portion and having a recess, the loudspeaker supporting portion supporting the loudspeaker and the cushion in a manner such that the loudspeaker and the cushion are fitted in the recess, and a second groove extending outward from the inner wall surface and receiving second one of the projections to loosely support the second one of the projections, the first groove being open in a backward direction, the second groove being open in a frontward direction and communicating with the recess. The packing has an opening for accommodating the microphone element and a rib projecting into the opening, the rib being in watertight contact with a side surface of the microphone element throughout its circumference.

This invention offers the following advantage. A cylindrical microphone element can be stably and highly reproducibly secured in both a sound path direction and a circumferential direction without using a dedicated securing component.

BRIEF DESCRIPTION OF THE DRAWINGS

FIG. 2(*b*) is a perspective view of an upper surface of the holder in FIG. 2(*a*).

FIG. 2(*c*) is an exploded sectional view of a part of the radio communication device in FIG. 1 which is taken along the line A-A of FIG. 2(*b*).

FIG. 2(*d*) is a sectional view of the members in FIG. 2(*c*) which are in assembled conditions.

FIG. 3(*b*) is a perspective view of a lower surface of the holder in FIG. 3(*a*).

FIG. 4(*b*) is a perspective view of the upper surface of the holder in FIG. 2(*a*) on which the microphone unit, the cushion, and the loudspeaker have been mounted.

DETAILED DESCRIPTION OF THE INVENTION

Figure 1:
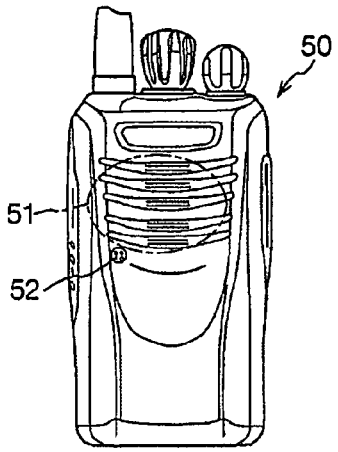
FIG. 1 is a front view of a portable radio communication device including a microphone-unit supporting structure according to an embodiment of this invention.
Figure 2A:
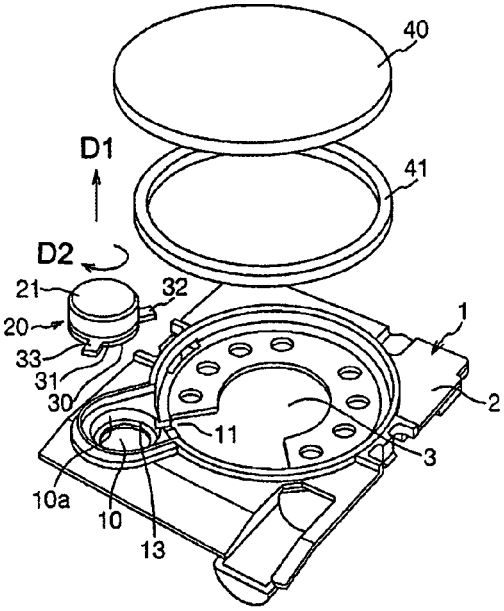
FIG. 2(*a*) is an exploded perspective view of a part of the radio communication device in FIG. 1 which includes a holder, a microphone unit, and a loudspeaker.
Figure 2B:
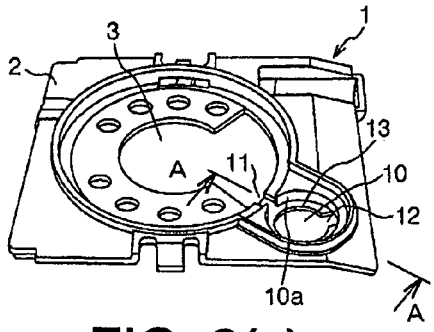
Figure 2C:
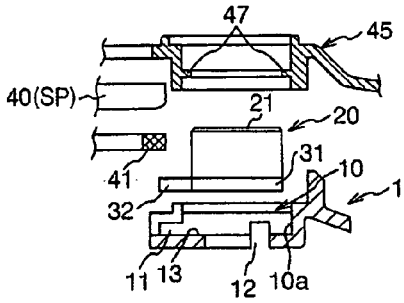
Figure 2D:
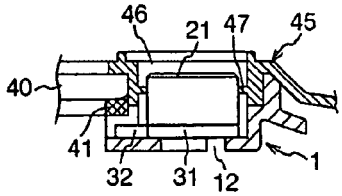

FIG. 1 shows a portable radio communication device 50 including a microphone-unit supporting structure according to an embodiment of this invention. The radio communication device 50 is an example of an electronic device. The radio communication device 50 has a front formed with a loudspeaker grill 51 and a microphone aperture area (an area having apertures for a microphone) 52.

Figure 3A:
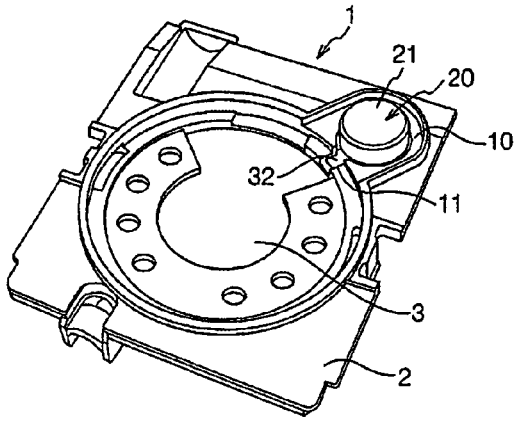
FIG. 3(*a*) is a perspective view of the upper surface of the holder in FIG. 2(*a*) on which the microphone unit has been mounted.
Figure 3B:
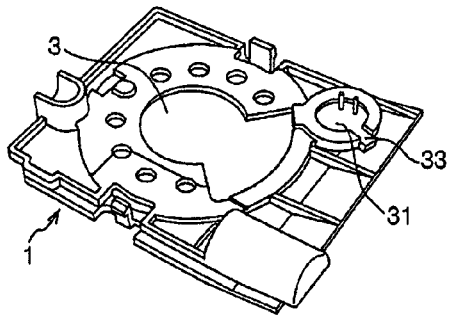
Figure 4A:
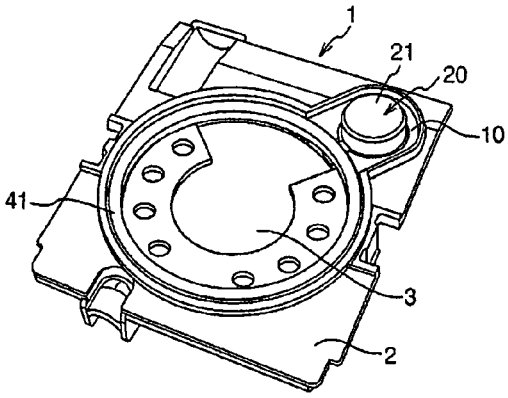
FIG. 4(*a*) is a perspective view of the upper surface of the holder in FIG. 2(*a*) on which the microphone unit and a cushion for the loudspeaker have been mounted.
Figure 4B:
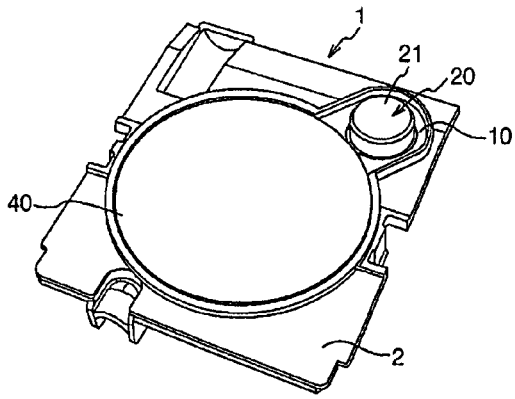
Figure 5A:
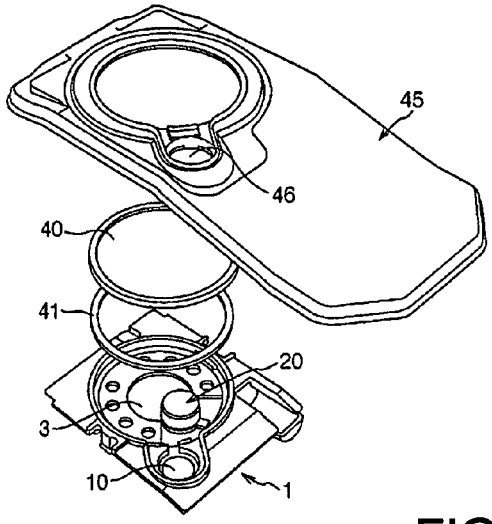
FIGS. 5(*a*), 5(*b*), and 5(*c*) are exploded perspective views of a part of the radio communication device in FIG. 1 which includes the holder, the microphone unit, the loudspeaker, the cushion, and a packing.
Figure 5B:
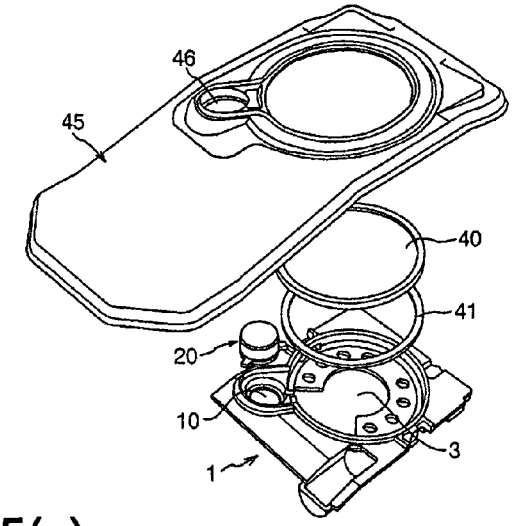
Figure 5C:
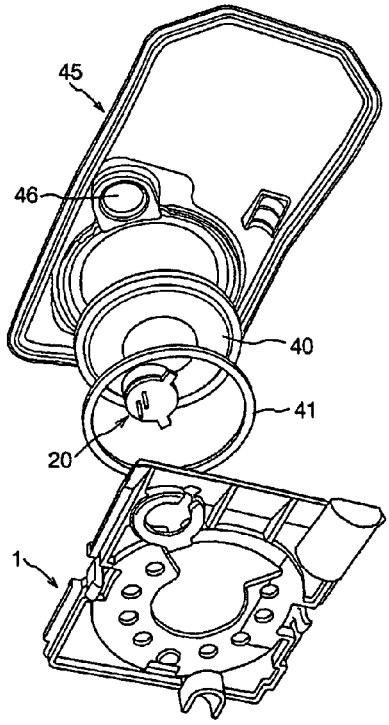

With reference to FIGS. 2(*a*)-2(*d*) and FIGS. 3(*a*) and 3(*b*), the microphone-unit supporting structure in the radio communication device 50 includes a holder 1 having a body 2 in the shape of an approximately rectangular plate. The holder body 2 is made of insulating material such as resin. A central area of the holder body 2 forms a portion 3 for supporting a loudspeaker 40. The holder body 2 has a portion 10 for supporting a substantially-cylindrical microphone unit 20. The microphone-unit supporting portion 10 is located adjacently outward of the periphery or circumference of the loudspeaker supporting portion 3. The loudspeaker supporting portion 3 has a circular recess for receiving the loudspeaker 40. In addition, the loudspeaker supporting portion 3 has a through hole at its bottom which communicates with the foregoing circular recess. The microphone-unit supporting portion 10 has an approximately cylindrical recess for receiving the microphone unit 20. In addition, the microphone-unit supporting portion 10 has a through hole at its bottom which communicates with the foregoing cylindrical recess.

The microphone unit 20 includes a microphone element 21 and a printed circuit board 30.

The microphone element 21 is approximately or substantially in the shape of a cylinder. The microphone element 21 has a front and a back formed by opposite end surfaces of the cylinder respectively. The front of the microphone element 21 faces in a direction D1 of a sound path along which sound travels or propagates. The microphone element 21 converts sound, which reaches its front, into a corresponding electric signal. The back of the microphone element 21 has terminals (not shown) via which the electric signal can be outputted.

The printed circuit board 30 is provided with a wiring pattern electrically connected with the terminals of the microphone element 21 by, for example, soldering. The printed circuit board 30 includes a microphone-element supporting portion 31 of an approximately circular shape, and two projections 32 and 33 extending radially outward from the microphone-element supporting portion 31. The microphone-element supporting portion 31 is substantially equal in diameter to the microphone element 21. The microphone-element supporting portion 31 is coaxially secured to the back of the microphone element 21. The projections 32 and 33 are circumferentially spaced at an angular interval different from an angle of 180 degrees. Thus, the angular interval between the projections 32 and 33 is such that when one of the projections 32 and 33 is assumed to be on a diametrical or radial reference line for line symmetry, the other is off the reference line.

The radio communication device 50 has a casing which accommodates a main printed circuit board (not shown). Preferably, the printed circuit board 30 is made as a member connected with the main printed circuit board via the projections 32 and 33. In other words, the printed circuit board 30 with the projections 32 and 33, and the main printed circuit board are made as a single board. Thereafter, the printed circuit board 30 with the projections 32 and 33 is separated from the main printed circuit board by, for example, trimming. The printed circuit board 30 will be referred to as the sub printed circuit board 30 hereafter.

The sub printed circuit board 30 and the main printed circuit board are simultaneously manufactured as a single board. When the microphone unit 20 is made, the sub printed circuit board 30 is separated from the original board by trimming or other processing. In other words, the original board is divided into the main printed circuit board and the sub printed circuit board 30. This design of the main printed circuit board and the sub printed circuit board 30 can reduce the number of steps in manufacturing the radio communication device 50 and the cost of the radio communication device 50. When the sub printed circuit board 30 is separated from the original board, the projections 32 and 33 are formed. Thus, the projections 32 and 33 are made by trimming or other processing.

In original conditions, the projections 32 and 33 are parts of a substrate for the sub printed circuit board 30 and the main printed circuit board, and form connection branches or bridges connecting the sub printed circuit board 30 and the main printed circuit board. According to a prior-art design, projections caused by trimming need to be partially cut and shortened to such lengths that the shortened projections will not interfere with other members during the assembly of a related device.

During the assembly of the radio communication device 50, the sub printed circuit board 30 with the projections 32 and 33 of a prescribed length is separated from the main printed circuit board by cutting.

The microphone-unit supporting portion 10 has cylindrical walls formed with an inner circumferential surface 10*a* defining a side of the related cylindrical recess. The dimensions and shape of the inner circumferential surface 10*a*, that is, those of the cylindrical recess, are chosen so that at least a lower end (back end) part of the microphone unit 20 can be fitted into the cylindrical recess and supported therein with a prescribed play provided between an outer cylindrical surface of the lower end part of the microphone unit 20 and the inner circumferential surface 10*a*. Accordingly, the microphone unit 20 is loosely supported in the cylindrical recess.

The microphone-unit supporting portion 10 has a radially inward projection or flange 13 at its bottom. The projection 13 circumferentially extends and takes a letter-C shape with a gap. The projection 13 may be integral with the walls of the microphone-unit supporting portion 10, that is, the walls of the holder body 2. The projection 13 forms a part of the bottom of the cylindrical recess in the microphone-unit supporting portion 10. In addition, the projection 13 forms a seat for supporting a part of the back of the microphone-element supporting portion 31 of the microphone unit 20. The projection 13 prevents the microphone unit 20 from moving through the holder 1. The microphone-unit supporting portion 10 has a front facing in the sound path direction D1 with respect to the microphone unit 20. The microphone unit 20 is inserted into the cylindrical recess in the microphone-unit supporting portion 10 from its back for being supported.

A front of the holder 1 has a groove 11 at the boundary between the loudspeaker supporting portion 3 and the microphone-unit supporting portion 10. The groove 11 is designed for loosely receiving the projection 32 of the microphone unit 20 when the microphone unit 20 is supported in the microphone-unit supporting portion 10. The walls of the holder 1 which define the groove 11 can support the projection 32 when the projection 32 is loosely fitted in the groove 11. The groove 11 extends radially outward from the inner circumferential surface 10*a* in the microphone-unit supporting portion 10. The groove 11 communicates with the circular recess in the loudspeaker supporting portion 3. The groove 11 radially extends through a ring flange located at the circumferential edge of the bottom of the circular recess. The groove 11 is open in a frontward direction at the front of the holder 1. The projection 32 extends into the bottom of the circular recess when being placed in the groove 11. At least a part of the projection 32 is located directly above a part of the walls of the holder 1 when the projection 32 is placed in the groove 11. Thus, downward or backward movement of the projection 32 is limited by the part of the walls of the holder 1.

A back of the holder 1 has a groove 12 for loosely receiving the projection 33 of the microphone unit 20 when the microphone unit 20 is supported in the microphone-unit supporting portion 10. The walls of the holder 1 which define the groove 12 can support the projection 33 when the projection 33 is loosely fitted in the groove 12. The gap in the projection 13 forms a portion of the groove 12. The remainder of the groove 12 extends radially outward from the inner circumferential surface 10*a* in the microphone-unit supporting portion 10. The groove 12 is open in a backward direction at the back of the holder 1. When the projection 33 is placed in the groove 12, at least a part of the projection 33 is located directly below a part of the walls of the holder 1. Thus, upward or frontward movement of the projection 33 is limited by the part of the walls of the holder 1.

The grooves 11 and 12 are circumferentially spaced at an angular interval different from an angle of 180 degrees. The angular interval between the grooves 11 and 12 is equal to that between the projections 32 and 33.

During the placement of the microphone unit 20 into the microphone-unit supporting portion 10, the projection 33 is inserted into the cylindrical recess and the through hole of the microphone-unit supporting portion 10. Thereafter, the projection 33 is positionally adjusted into agreement with the groove 12, and is then inserted and fitted into the groove 12. As the projection 33 is positionally adjusted into agreement with the groove 12, the projection 32 automatically moves into positional agreement with the groove 11. As the projection 33 is fitted into the groove 12, the projection 32 automatically fits into the groove 11. Then, the microphone unit 20 is seated on the projection (seat) 13.

When the microphone unit 20 is in position with respect to the microphone-unit supporting portion 10, the projects 32 and 33 are supported in the grooves 11 and 12 so that rotation of the microphone unit 20 relative to the microphone-unit supporting portion 10 in a circumferential direction D2 (see FIG. 2(*a*)) is limited. In addition, the grooves 11 and 12 extend in the front and back of the holder 1 respectively so that movement of the microphone unit 20 relative to the microphone-unit supporting portion 10 in the sound path direction (axial direction) is limited by the walls of the holder 1. Since the angular interval between the projections 32 and 33 and that between the grooves 11 and 12 differ from an angle of 180 degrees, the microphone unit 20 is prevented from being located at a wrong angular position with respect to the microphone-unit supporting portion 10. Thus, the microphone unit 20 is always located at a correct angular position with respect to the microphone-unit supporting portion 10.

Leads (not shown) to be connected with terminals on the main printed circuit board extend from the microphone unit 20. Since the microphone unit 20 is always located at the correct angular position with respect to the microphone-unit supporting portion 10, directions along which the leads extend from the microphone unit 20 are always equal to given directions. Therefore, it is possible to enhance efficiency of work about connecting the leads with the terminals on the main printed circuit board.

Generally, if leads extending from a microphone unit pick up signals radiated by digital circuits and radio-frequency circuits, the picked-up signals might be converted into audio signals before being outputted from a microphone element in the unit as noise sound. Therefore, a general radio communication device is in such particular conditions that the positions of leads extending from a microphone unit are limited depending on the positions of other electronic parts. Thus, the general radio communication device needs to meet the requirements that the microphone unit should not be rotated relative to the body of the device to fix the directions of the leads extending from the microphone unit. The microphone-unit supporting structure according to the embodiment of this invention is able to meet such requirements.

As shown in FIGS. 2(*a*) and 4(*a*), an annular cushion 41 for supporting a back of the loudspeaker 40 is fitted into the circular recess in the loudspeaker supporting portion 3, and is attached to the walls of the holder 1 which define a part of the bottom of the circular recess. The attached cushion 41 covers a part of the groove 11. As shown in FIGS. 2(*a*) and 4(*b*), the loudspeaker 41 is placed and mounted onto the cushion 41 while being fitted into the circular recess in the loudspeaker supporting portion 3. The cushion 41 covering the part of the groove 11 inhibits the projection 32, which is loosely fitted and supported in the groove 11, from moving in the frontward direction. Thus, the microphone unit 20 is prevented from falling off from the holder 1 or the microphone-unit supporting portion 10. Specifically, the loudspeaker 41 presses the cushion 41 into watertight contact with a part of the projection 32 in the groove 11.

During the assembly of the radio communication device 50, the microphone unit 20 and the loudspeaker 40 are mounted on the holder 1. The microphone unit 20 and the loudspeaker 40 mounted on the holder 1, and the main printed circuit board (not shown) are electrically connected by leads (not shown). Subsequently, the holder 1 and the main printed circuit board are fixed to a chassis (not shown) of the radio communication device 50. As shown in FIGS. 2(*c*) and 2(*d*) and 5(*a*)-5(*c*), a packing 45 which has a circular opening for the loudspeaker 40 and a circular opening 46 for the microphone element 21 is fitted over the holder 1 and the chassis from their fronts. The packing 45 enables the loudspeaker 40 and the microphone unit 20 to be stably secured to the holder 1.

As shown in FIG. 2(*d*), the microphone element 21 moves into the opening 46 in the packing 45. The walls of the packing 45 which defines the opening 46 have an annular rib 47 projecting radially inward into the opening 56. The rib 47 is in watertight contact with the side surface of the microphone element 21 throughout the circumference while being elastically deformed. Thus, the rib 47 serves as a waterproofing wall for the microphone element 21.

Before the packing 45 is located in position, the microphone unit 20 is loosely fitted and supported in the holder 1. Accordingly, the microphone unit 20 is loosely positioned relative to the chassis. Thus, variations in relative position between the microphone unit 20 and the opening 46 in the packing 45 can be properly absorbed when the packing 45 is located in position.

The chassis over which the packing 45 has been fitted is located at a prescribed place within the interior of the radio communication device 50.

There are the two projections 32 and 33 which extend radially outward from the microphone-element supporting portion 31. There may be three or more such projections. In this case, it is necessary to meet the conditions where when one of the projections is assumed to be on a diametrical or radial reference line for line symmetry, the others are off the reference line.

What is claimed is:

1. A microphone-unit supporting structure comprising a microphone unit and a holder;

wherein the microphone unit includes a substantially-cylindrical microphone element having a front and a back, a printed circuit board fixed to the back of the microphone element, and at least two projections extending radially outward from the printed circuit board and being circumferentially spaced at such an angular interval that when one of the projections is assumed to be on a reference line for line symmetry, the other projection or projections are off the reference line; and wherein the holder includes a microphone-unit supporting portion having a front, a back, and an inner wall surface and supporting the microphone unit in a manner such that at least a back end part of the microphone unit is loosely fitted in the microphone-unit supporting portion and at least a part of a side of the microphone unit faces the inner wall surface, a seat projecting from the inner wall surface and supporting a part of the printed circuit board, a first groove extending outward from the inner wall surface and receiving first one of the projections to loosely support the first one of the projections, and a second groove extending outward from the inner wall surface and receiving second one of the projections to loosely support the second one of the projections, the first groove being open in a backward direction, the second groove being open in a frontward direction.

2. A microphone-unit supporting structure as recited in claim 1, further comprising a loudspeaker, a cushion supporting a back of the loudspeaker, and a loudspeaker supporting portion provided in the holder and having a recess, the loudspeaker supporting portion supporting the loudspeaker and the cushion in a manner such that the loudspeaker and the cushion are fitted in the recess, the loudspeaker supporting portion being adjacent to the microphone-unit supporting portion, the second groove communicating with the recess, the cushion being in watertight contact with a part of the second one of the projections which is in the second groove.

3. A microphone-unit supporting structure as recited in claim 1, further comprising a packing fitting over a front of the holder and having an opening for accommodating the microphone element and a rib projecting into the opening, the rib being in watertight contact with a side surface of the microphone element throughout its circumference.

4. A microphone-unit supporting structure as recited in claim 1, wherein the projections are formed when the printed circuit board is separated from an original printed circuit board by trimming.

5. An electronic device comprising a microphone unit, a holder, a loudspeaker, a cushion supporting a back of the loudspeaker, and a packing fitting over a front of the holder;

wherein the microphone unit includes a substantially-cylindrical microphone element having a front and a back, a printed circuit board fixed to the back of the microphone element, and at least two projections extending radially outward from the printed circuit board and being circumferentially spaced at such an angular interval that when one of the projections is assumed to be on a reference line for line symmetry, the other projection or projections are off the reference line;

wherein the holder includes a microphone-unit supporting portion having a front, a back, and an inner wall surface and supporting the microphone unit in a manner such that at least a back end part of the microphone unit is loosely fitted in the microphone-unit supporting portion and at least a part of a side of the microphone unit faces the inner wall surface, a seat projecting from the inner wall surface and supporting a part of the printed circuit board, a first groove extending outward from the inner wall surface and receiving first one of the projections to loosely support the first one of the projections, a loudspeaker supporting portion being adjacent to the microphone-unit supporting portion and having a recess, the loudspeaker supporting portion supporting the loudspeaker and the cushion in a manner such that the loudspeaker and the cushion are fitted in the recess, and a second groove extending outward from the inner wall surface and receiving second one of the projections to loosely support the second one of the projections, the first groove being open in a backward direction, the second groove being open in a frontward direction and communicating with the recess; and wherein the packing has an opening for accommodating the microphone element and a rib projecting into the opening, the rib being in watertight contact with a side surface of the microphone element throughout its circumference.

* * * * *